US009179529B2

(12) United States Patent
Cessna

(10) Patent No.: US 9,179,529 B2
(45) Date of Patent: Nov. 3, 2015

(54) OPTICAL PACING SYSTEM AND METHOD

(71) Applicant: Joel R. Cessna, Wooster, OH (US)

(72) Inventor: Joel R. Cessna, Wooster, OH (US)

( * ) Notice: Subject to any disclaimer, the term of this patent is extended or adjusted under 35 U.S.C. 154(b) by 402 days.

(21) Appl. No.: 13/649,188

(22) Filed: Oct. 11, 2012

(65) Prior Publication Data

US 2013/0187553 A1 Jul. 25, 2013

Related U.S. Application Data

(60) Provisional application No. 61/590,162, filed on Jan. 24, 2012.

(51) Int. Cl.
*H05B 37/00* (2006.01)
*H05B 37/02* (2006.01)

(52) U.S. Cl.
CPC ..... *H05B 37/029* (2013.01)

(58) Field of Classification Search
CPC ..... H05B 37/02; H05B 37/029
USPC ..... 315/161, 312, 323
See application file for complete search history.

(56) References Cited

U.S. PATENT DOCUMENTS

| | | | | |
|---|---|---|---|---|
| 2,457,968 | A | 1/1949 | Allen et al. | |
| 3,119,610 | A | 1/1964 | Clinton | |
| 3,492,582 | A | 1/1970 | Heywood | |
| 3,665,452 | A | 5/1972 | MacCreadie | |
| 3,846,704 | A | 11/1974 | Bessette | |
| 3,872,423 | A | 3/1975 | Yeakley | |
| 3,893,099 | A | 7/1975 | Zoepfl | |
| 4,028,693 | A | 6/1977 | Kuntz | |
| 4,070,016 | A | 1/1978 | Dumas | |
| 4,627,620 | A | 12/1986 | Yang | |
| 4,728,100 | A | 3/1988 | Smith | |
| 4,752,764 | A | 6/1988 | Peterson et al. | |
| 5,325,340 | A | 6/1994 | Ramsey | |
| 5,402,188 | A | 3/1995 | Wayne | |
| 5,451,922 | A | 9/1995 | Hamilton | |
| 5,897,457 | A | 4/1999 | Mackovjak | |
| 6,086,379 | A | 7/2000 | Pendergast et al. | |
| 6,213,781 | B1 | 4/2001 | Kimball | |
| 8,504,164 | B2 * | 8/2013 | Karr | 607/60 |
| 2006/0030458 | A1 | 2/2006 | Heywood | |
| 2007/0061436 | A1 * | 3/2007 | Bae et al. | 709/223 |
| 2007/0213126 | A1 | 9/2007 | Deutsch et al. | |
| 2009/0231159 | A1 * | 9/2009 | Selevan | 340/907 |

* cited by examiner

*Primary Examiner* — Hai L Nguyen
(74) *Attorney, Agent, or Firm* — Sand & Sebolt

(57) ABSTRACT

A system and method for optically setting a pace for an athlete is presented. The method sequentially places a first group of lights and a second group along a path travelled by the athlete. The first group of lights are sequentially lit one after another one at a time with a first predetermined delay between the lighting of each of the lights. After all the first group of lights have been lit, the second group of lights are similarly sequentially lit in sequence with a second predetermined delay between each of the lights. The first and second predetermined delays can be the same if the athlete desires to run several consistent laps of the same speed. However, the athlete may desire to run one part of the laps fast and the another part slower by setting one predetermined delay longer than the other predetermined delay.

25 Claims, 5 Drawing Sheets

OPTICAL PACING SYSTEM AND METHOD

CROSS REFERENCE TO RELATED APPLICATION

This application claims priority from U.S. Provisional Patent Application Ser. No. 61/590,162, filed Jan. 24, 2012; the disclosure of which is incorporated herein by reference.

BACKGROUND OF THE INVENTION

1. Field of Invention

The current invention relates generally to apparatus, systems and methods for training athletes. More particularly, the apparatus, systems and methods relate to pacing athletes while training. Specifically, the apparatus, software systems and methods provide for illuminating lights to set a pace for an athlete.

2. Description of Related Art

Often athletes such as runners, swimmers, skaters, skiers, bikers and the like will often run, swim, skate, ski, bike or otherwise propel themselves forward and often repeatedly complete multiple laps. Coaches and trainers currently yell out times often read from a stop watch. Alternatively, it is up to the athlete to carry or locate a fixed clock so that they might have some idea what their pace and/or current time might be. Often when an athlete travels longer distances, these few and often sporadically yelled out and/or manually read times by the athlete provide limited use for that athlete to exactly determine their pace within the context of their training. Additionally, having to process a time and determine what pace the athlete is on is disruptive to their concentration and form. What is needed is a better way for athletes to know their pace when training.

SUMMARY

The preferred embodiment of the invention includes a method for setting the pace for an athlete by sequentially lighting lights one after another in a one time sequence as in sprints or a round-robin fashion for longer distances involving more than one lap. The method places lights, including a first light, a second light and a third light along a path to be traveled by an athlete. The preferred embodiment will be discussed with reference to just three lights to simplify the example operation of the lights. However, in practice the method may be used 10 lights, 100 lights, 4000 lights or any number of lights. The lights are lightweight and easily handled to be placed in their proper locations. The lights are housed independently in lighting units with the first light in a first lighting unit, the second light in a second lighting unit and the third light in a third lighting unit. No wires connect any of the lighting units. The method begins pacing the athlete by lighting the first light but not yet lighting the second and third lights. Next, the second light detects that the first light has been lit and a predetermined time after detecting the first light has been lit the second light turns on. The first light is turned off another predetermined time after the first light has been lit. In general, the first light is turned off about when the second light is lit. Next, the third light detects that the second light has been lit and waits a predetermined time after that before it is lit.

In some configurations of the preferred embodiment, a wireless signal is emitted from a first lighting unit housing the first light when the first light is lit. The second light can then detect that the first light has been lit by receiving the wireless signal. Other lights can also emit wireless signals so that adjacent lights can detect that they were lit. The wireless signal may have a unique ID or address to indicate which light emitted that signal. Again, 40, 400, 4000 or any number of lights may be used.

Another configuration of the preferred embodiment is a system to pace an athlete about a path the athlete follows. The system includes lights that includes a first light, a second light and a third light. Of course, the method can include 10, 40, 100, 2000 or any number of lights as needed to pace an athlete in any type of sporting environment. Three lights are used to explain the operation of this system but other lights would operate in a similar way. The system further includes a first light housing to house the first light, a second light housing to house the second light and a third light housing to house the third light. The first, second and third lights can each be one or more light emitting diodes (LEDs). A first base housing is mounted to the first housing to form a first light unit. Similarly, a second base housing is mounted to the second light housing to form a second light unit and a third base housing is mounted to the third light housing to form a third light unit. The first, second and third light housings can be formed with a transparent cylindrically-shaped tube with a spherical top end. The first, second and third lights are respectively in the first light housing, second light housing and third light housing. The first light unit, second light unit and third light unit are portable. The system includes a controller with a software program to sequentially light the first light, then the second light and then the third light.

Another configuration of the preferred embodiment is a method of setting a pace along a path traveled by an athlete. The method sequentially places a first group of lights along a first portion of the path travelled by the athlete and then sequentially places a second group of lights along a second portion of the path travelled by the athlete. This method can include any number of lights. The first group of lights are sequentially lit one after each other one at a time. There is a first predetermined delay between the lighting of each of the first group of lights. After all the first group of lights have been lit, the second group of lights are sequentially lit one after each other one at a time. There is a second predetermined delay between the lighting of each of the second group of lights.

If the athlete desires to run the same speed on the path, then the first predetermined delay is the same as the second predetermined delay. If the athlete desires to run the part of the path with the first group of lights at one rate and the part of the path with the second group of lights at a second rate then the first and/or second predetermined delay can be changed so that the second predetermined delay is different from the first predetermined delay. This value can be changed by transmitting a command to the first and/or second group of lights that will cause the first and/or second group of lights to change their first and/or second predetermined delay. This message can be wirelessly broadcast from a digital device.

BRIEF DESCRIPTION OF SEVERAL VIEWS OF THE DRAWINGS

One or more preferred embodiments that illustrate the best mode(s) are set forth in the drawings and in the following description. The appended claims particularly and distinctly point out and set forth the invention.

The accompanying drawings, which are incorporated in and constitute a part of the specification, illustrate various example methods, and other example embodiments of various aspects of the invention. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
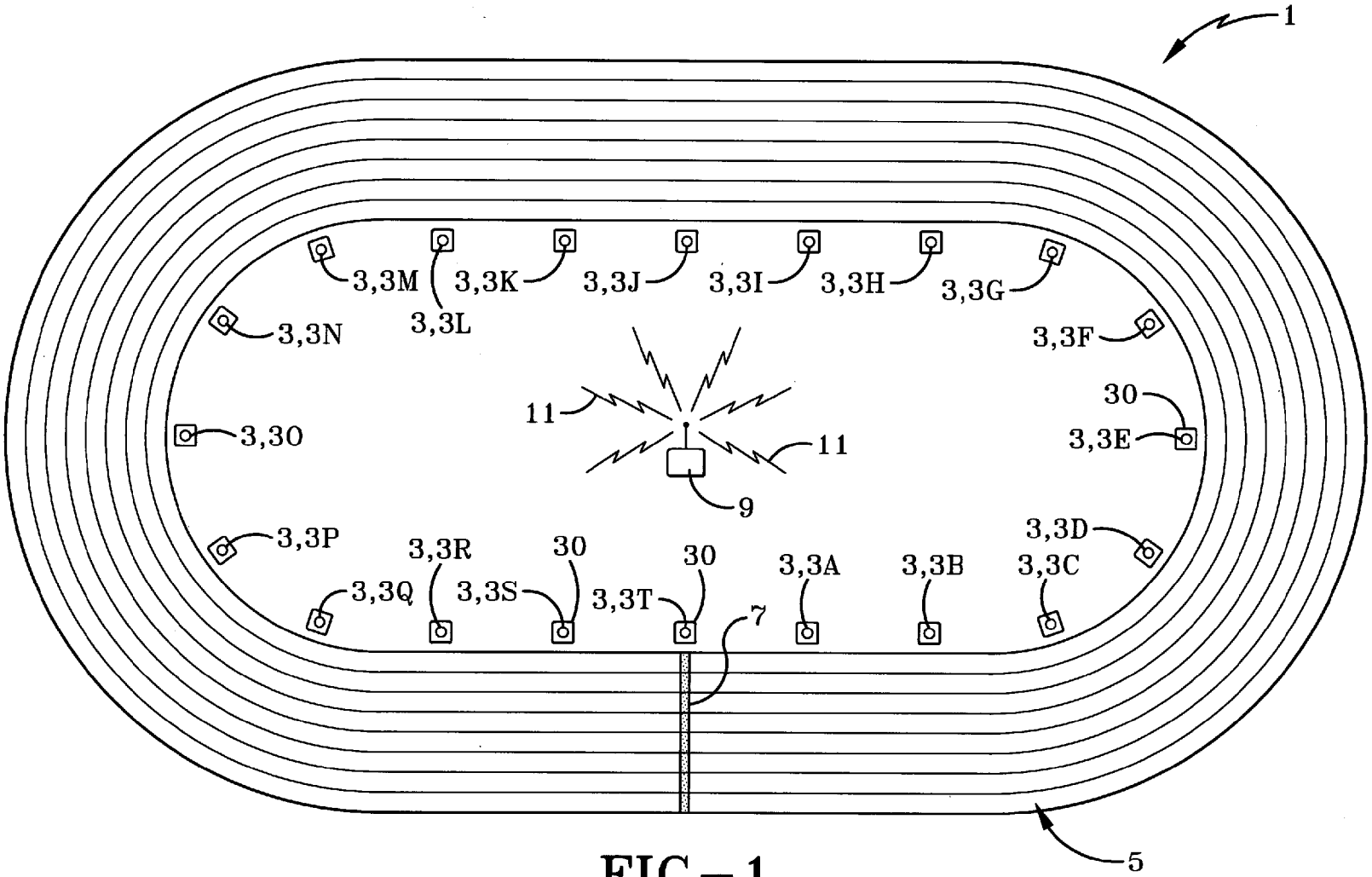
FIG. 1 illustrates a preferred embodiment of a system of lights for pacing an athlete.

FIG. 1 illustrates the preferred embodiment of a system 1 for setting the pace for an athlete. The system 1 includes light devices 3, that include at least a first light device 3A, a second light device 3B and a third light device 3C, a fourth light device 3D and so on up to light device 3R. These three lights are used to describe how each of the lights 3 operate even though there may be many more than three lights in the system 1. For example, 40 light devices 3 could be spaced every 10 meters on a 400 meter track, a cross-country course might have 1000 lights devices 3 and other pacing environments can have a different number of lights devices 3. In the preferred embodiment, the light devices 3 are mobile and easily carried to and placed around a track 5 such as a running/jogging track. Even though a track 5 is illustrated in the preferred embodiment, the light devices 3 can also be placed in a pool along a path followed by a swimmer, on a ski trail, in a skating rink, obstacle courses for professional football, baseball, basketball, soccer, and military combines, and the like. The system 1 of light devices 3 can also be used by individuals, businesses, schools or colleges in a wide variety of configurations and colors. The lights could even be placed on goal posts and lit during field goals to allow kickers and referees to better judge the accuracy and placement of the ball between the uprights. In general, the system 1 can be used for any type of pacing for an athlete traveling through space and time in any type of sporting activity that involves traversing a specific distance between a specific starting location and an ending location. It can also be used to train an athlete or other personnel to react to different light sequences. As discussed below, the light devices 3 are preferably independently wirelessly controlled but in other configurations, the light devices 3 can be wired together.

The track 5 can include a starting line 7. As illustrated in FIGS. 3A-3C, when the pacing system 1 is in use a start signal is given to the first light device 3A to begin the system's pacing operations. For example, an electronic device 9 such as a computer, cellular phone, iPad or the like can generate a wireless signal 11 to turn on the first light device 3A. For example, the electronic device 9 can generate a wireless message that includes an address that is unique to the first light device 3A. This wireless message can be received by a controller 13 (See FIG. 2) at the first light device 3A and the controller 13 can compare the received address to the address associated with the first light device 3A. If the addresses match, then the controller 13 will illuminate the first light device 3A. The electronic device can be a handheld device that can control the pacing system 1 as discussed below and can even be used to turn individual light devices 3 on and off.

In one configuration of the preferred embodiment, the electronic device 9 can wait a predetermined time after the first light device 3A has been turned on and then generate a second message addressed to the second light device 3B instructing it to turn on. At the same time or soon after, the electronic device 9 can generate another message addressed to the first light device 3A instructing it to turn off. Next, the electronic device 9 can wait a predetermined time after the second light device 3B has been turned on and then generate another message addressed to the third light device 3C instructing it to turn on. The electronic device 9 is configured to continue to sequentially turn the other light devices 3 on and off in a round-robin cyclic type of sequence as all the light devices 3 in the track 5 are sequentially turned on and off.

However, in the preferred embodiment, after the electronic device 9 turns on the first light device 3A to begin the pacing actions of the system 1, it does not need to generate further messages to turn on subsequent light devices 3. In the preferred embodiment, when the first light device 3A is turned on, a controller 13 in the light can cause a wireless signal to be emitted and the second light device 3B can detect this signal. When the controller 13 of the second light device 3B detects this signal, it can begin to wait a predetermined time and then turn the second light device 3B on. The controller 13 of the second light device 3B can generate a wireless signal when the second light device 3B is turned on. Similar to light device 3B, when a controller 13 of the third light device 3C detects this signal, it can begin to wait a predetermined time and then turn the third light device 3C on. The light devices 3 can continue to turn on and off in a round-robin cyclic type of sequence around the track 5 before reaching the last light device 3 at the starting line 7. If only one lap around the track is desired, the lighting of the lights ends at the last light at the starting line 7. However, if two or more laps are desired, then the controller 13 can be configured to include in its message to the first light device 3A that tells it to turn on and to also turn on again after waiting a predetermined time after detecting the last light at the starting line has turned on. For example, the digital device 9 can be used to configure the controller 13 of the first light device 3A to turn on for any amount of subsequent laps.

Figure 2A:
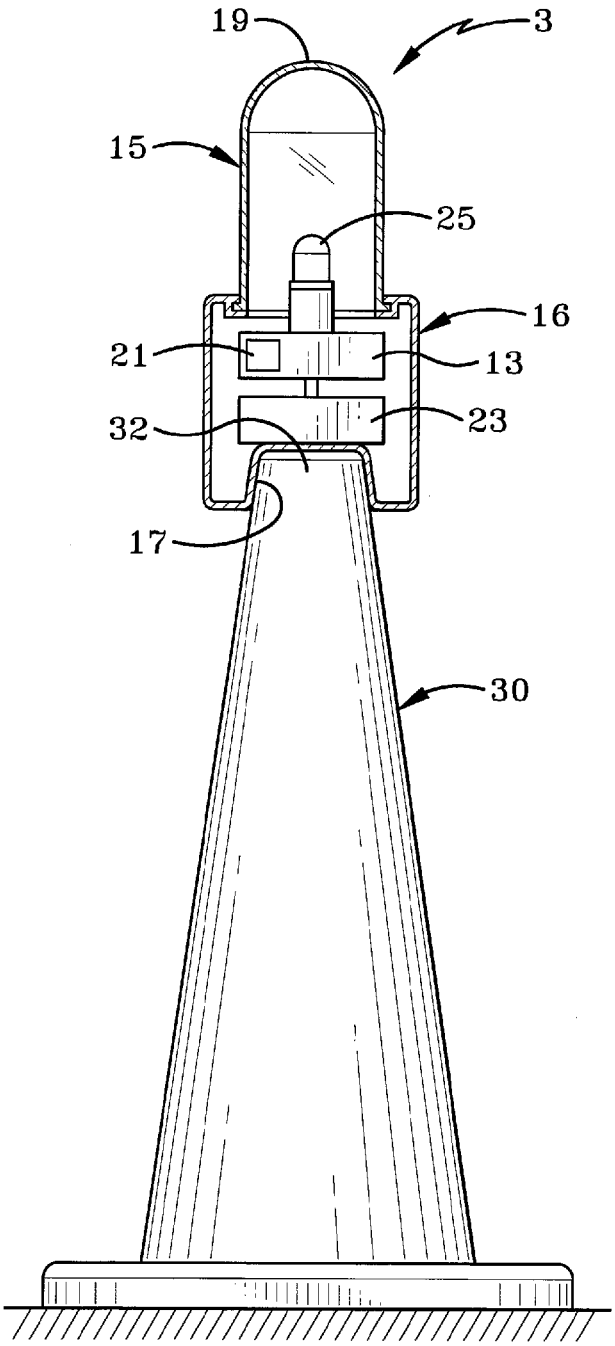
FIG. 2A illustrates a detailed view of a preferred embodiment of one of the light units for pacing an athlete that can be placed over the top of a cone.
Figure 3A:
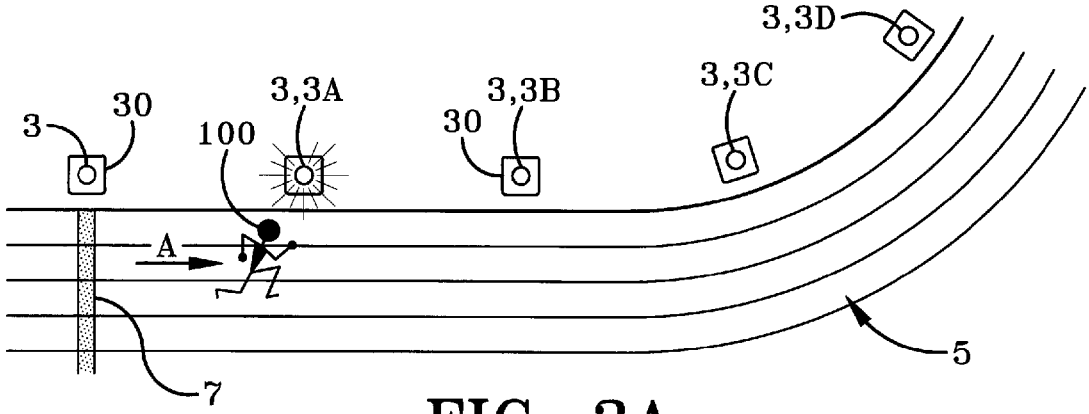
FIGS. 3A-3C illustrated an example sequence of events of how a runner would use one configuration of the preferred embodiment.
Figure 3B:
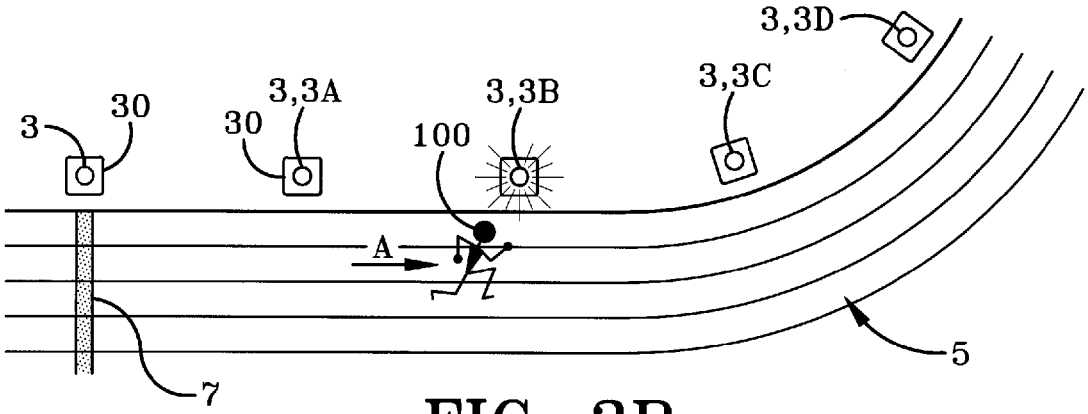
Figure 3C:
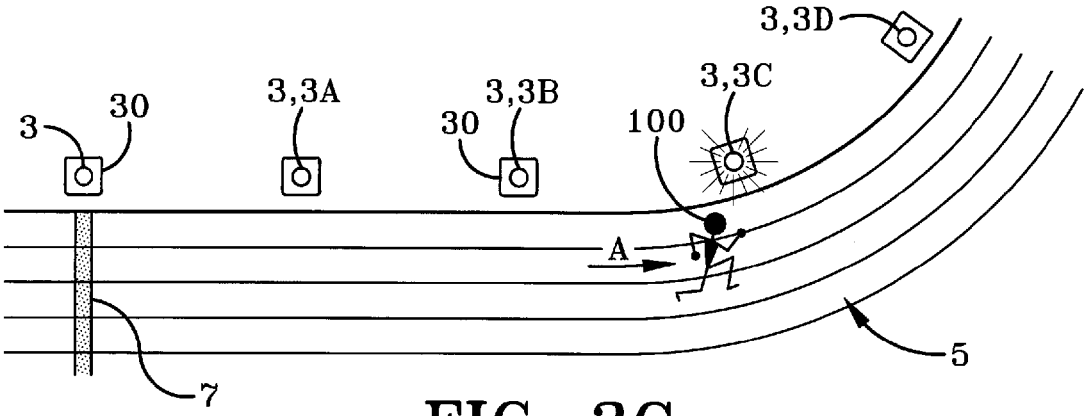

FIG. 2A illustrates an example preferred embodiment of how one of the light devices 3 is implemented. The light device 3 includes a light housing 15 and a base housing 16. The light housing 15 is preferably clear transparent material that lets light pass through or it can be colored. It is generally an elongated cylindrical shape with a spherical top 19. The base housing 16 is generally a rectangular-shaped box with a hollow interior in which the controller 13 (discussed in greater detail above) and a power supply 23 are mounted. The base housing 16 can be other shapes such as cylindrical shapes and can be made out of plastic or another suitable material to support the controller 13 and the power supply 23. The controller 13 can include a timer 21 that is used as discussed in greater detail below to determine a predetermined time after an adjacent light has been lit. A light 25 is mounted in the light housing 15. Alternatively, the light can be mounted to the top of the base housing 16 as long as it can still project light through the light housing 15. The light is preferably one or more light emitting diodes (LEDs) or other illumination type of device.

Figure 2B:
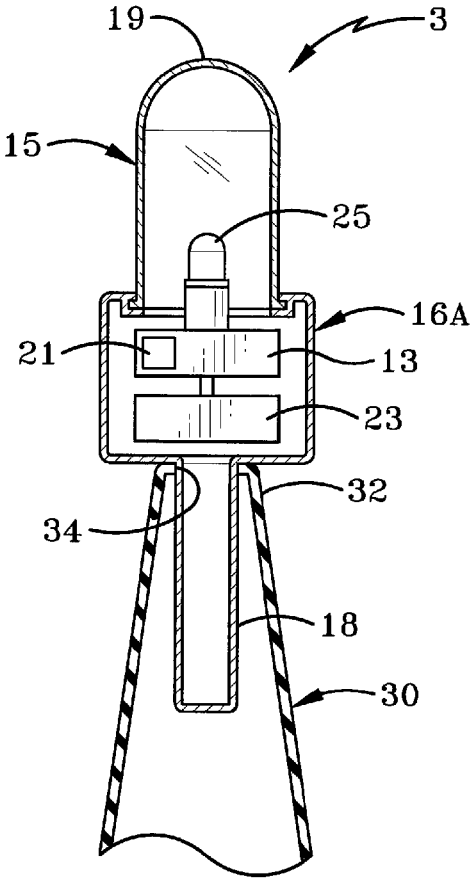
FIG. 2B illustrates a detailed view of a preferred embodiment of one of the light units for pacing an athlete that can be partially slid into the top of a cone.

The base housing 16 is shaped so that an open area 17 in the bottom of the housing 16 can easily be placed over a top portion 32 of a safety cone 30. FIG. 2B illustrates that alternatively an extending portion 18 of the an alternative base housing 16A could be configured to slide into a portion of the top 32 of the cone 30 so that a bottom side 34 of the base housing 16 rests on the top 32 of the cone 30. These example Figures illustrate that these light devices 3 can easily and quickly be placed on existing cones at a track or other facility or they, in combination with their cones 30, can also quickly and easily be set up and later removed.

The controller 13 can be implemented out of any kind of logic. For example, it can be custom built using hardware mounted onto a printed circuit board and can contain a universal serial bus (USB) radio for receiving and decoding messages from the digital device 9.

"Logic", as used herein, includes but is not limited to hardware, firmware, software and/or combinations of each to perform a function(s) or an action(s), and/or to cause a function or action from another logic, method, and/or system. For example, based on a desired application or needs, logic may include a software controlled microprocessor, discrete logic like an application specific integrated circuit (ASIC), a programmed logic device, a memory device containing instructions, or the like. Logic may include one or more gates, combinations of gates, or other circuit components. Logic may also be fully embodied as software. Where multiple logical logics are described, it may be possible to incorporate the multiple logical logics into one physical logic. Similarly, where a single logical logic is described, it may be possible to distribute that single logical logic between multiple physical logics.

Figure 4:
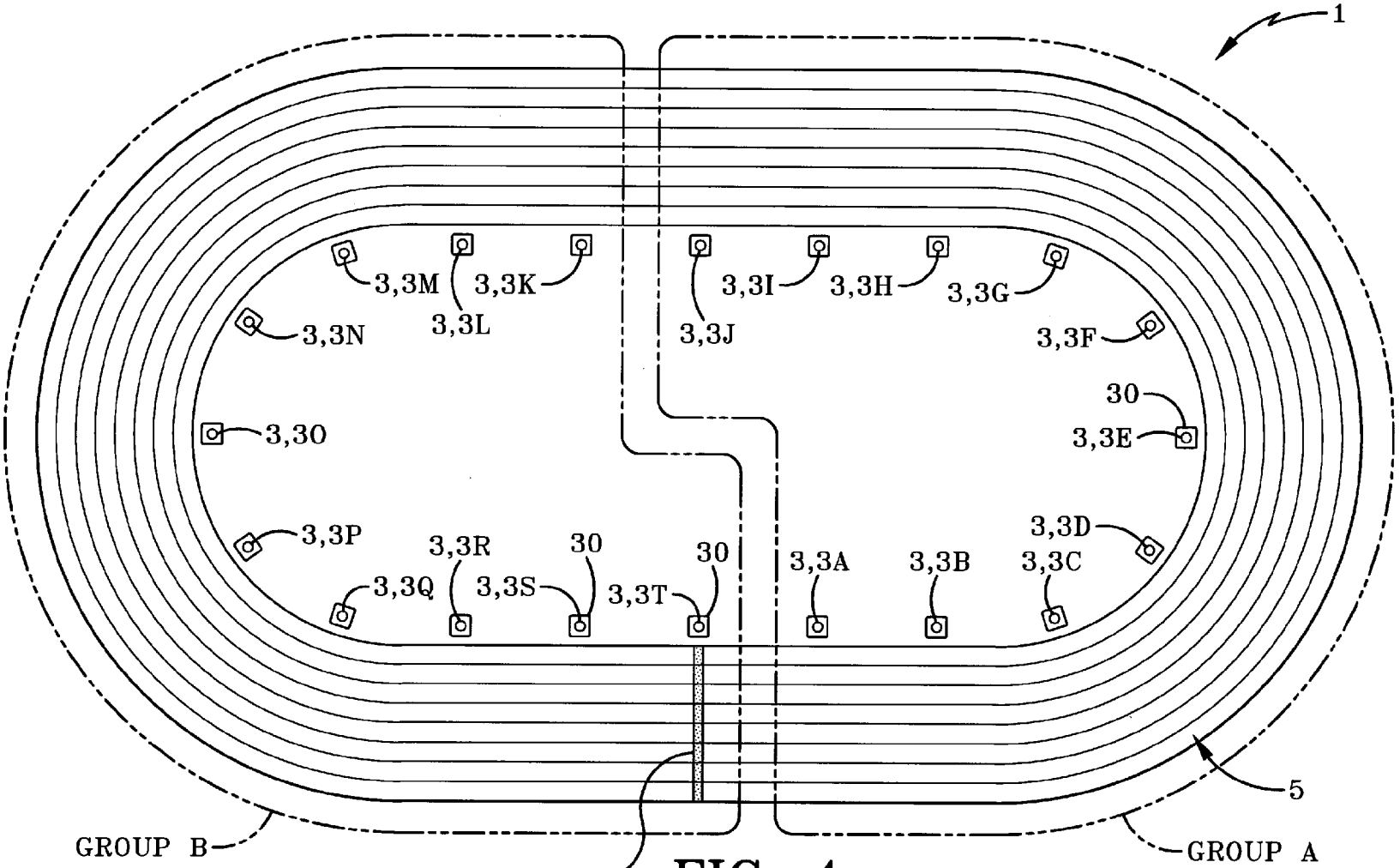
FIG. 4 illustrates a preferred embodiment of a system of lights for pacing an athlete that used two groups of light units.

FIG. 4 is an example illustration that shows the flexibility of the preferred embodiment. In this example, the light devices 3 are divided into Groups A and B. The light devices 3 in Group A are lit up in sequence faster than the light devices 3 in Group B. For example, each light device 3 in group A waits a group A predetermined time after a light adjacent to it lights up before lighting its light 25. Each device 3 in group B waits a predetermined time after a lighting device 3 adjacent to it lights up before lighting up its light where the group B predetermined time is longer than the group A predetermined time. This might allow an athlete to run the first part of the lap fast and have a bit of a rest on the second part of the lap or vice versa running the last part of the lap faster than the first part before beginning the next lap. Or run the last lap faster or even the latter part of the final lap much faster than the previous laps. The predetermined times can be wirelessly sent from an electronic device to each of the light devices 3. The controller 13 can decode the message and store its predetermined time in a memory location. When an adjacent light turns on, the controller 13 can configure a timer 21 to count up to a number representing the predetermined time. A clock with a known periodic time can be used to clock the timer. When the controller 13 determines that the timer 21 has reached the predetermined time it will light its light 25. Of course, there can be more groups than illustrated in the example of FIG. 3 and it is even conceivable that predetermined times for one or more of the light units 3 can be changed using software running on the portable device 13, that may be a laptop computer, at any time even when the system 1 is in use.

In yet another configuration, the lights 3 can be placed on helmets such as football helmets. The digital device 9 (which can be a handheld device) can then be used to turn individual lights on and off. For example, football receivers in practice can wear helmets with lights on them and then during the middle of a play a coach can light one of the lights to indicate to a quarterback which receiver he should throw the ball to. Of course, the lights can be placed anywhere on an athlete, not just their helmet, and can also be used in other supports such as soccer, baseball, basketball, etc. to indicate where the ball is to go. In other athletic training or drilling, lights locate on the players can dynamically indicate other actions the players are to perform upon seeing a light turn on.

The pacing system 1 can also include a charging system to charge the light devices 3 while they are not being used. For example, a charger can charge up to ten light devices 3 at a time so for a system that uses 40 lights to pace an athlete around a 400 meter track (with lights placed every ten meters) four charges could charge the 40 light devices 3. Of course, other chargers could be designed that charge more or less than ten light devices 3. Preferably, the charger could charge lights attached to it in about eight hours or less. The charger could convert a 110V into a lower direct current required to charge batteries in the light devices 3 and in other countries the charger could convert other alternating voltages into voltages required to charge the batteries.

The preferred embodiment of a pacing system 1 is an improvement on what currently exists to set the pace of an athlete. Currently, coaches for all types of sports try to yell out times to athletes of different sports or racers after the coach looks at his stopwatch. By yelling the time out, it is too late for the athlete to adjust his pace. With the light system 1, the athlete can continuously see exactly where he should be to be on pace. Also, software running in the electronic device 9 can be used to adjust the final time up or down during training depending on how the athlete is keeping pace with the lights. This allows the coach to push and to train his athletes much harder than ever before. With the light pacing system 1, the coach and athlete can see exactly where the athlete needs to be to be on pace with the desired preselected time. This system 1 provides for no break in the concentration or form of the athlete.

Example methods may be better appreciated with reference to flow diagrams. While for purposes of simplicity of explanation, the illustrated methodologies are shown and described as a series of blocks, it is to be appreciated that the methodologies are not limited by the order of the blocks, as some blocks can occur in different orders and/or concurrently with other blocks from that shown and described. Moreover, less than all the illustrated blocks may be required to implement an example methodology. Blocks may be combined or separated into multiple components. Furthermore, additional and/or alternative methodologies can employ additional, not illustrated blocks.

Figure 5:
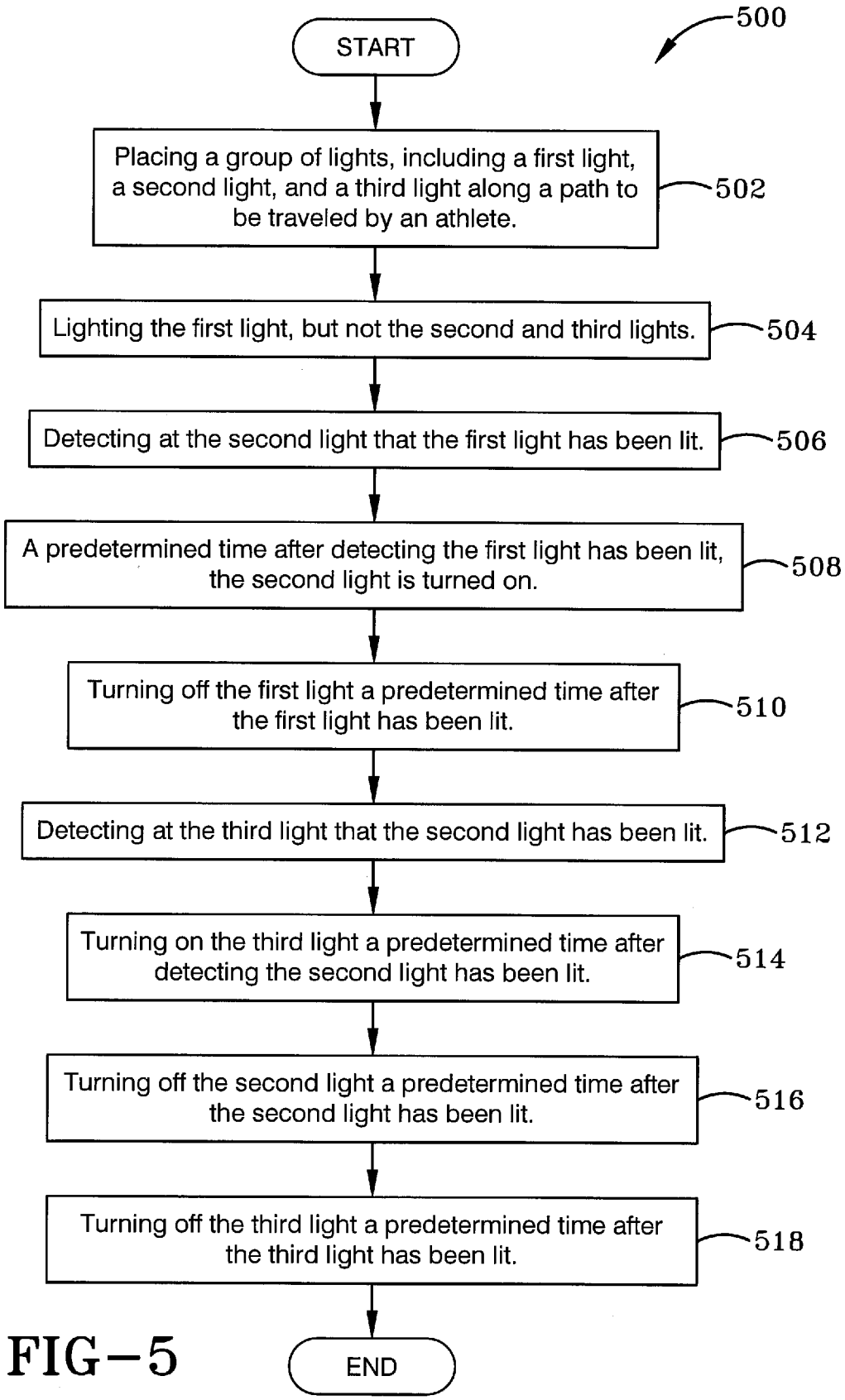
FIG. 5 illustrates an embodiment of a method for pacing an athlete with lights.

FIG. 5 illustrates a method 500 for setting the pace for an athlete. The method begins by placing a group of lights, including a first light, a second light and a third light along a path to be traveled by an athlete, at 502. Of course, as previously mentioned in other places any number of lights can be used. Forty lights may be used along an oval track, 1000 or more lights might be used on a cross-country path or obstacle course, and different numbers of lights can be used in other sports. Each of the lights is housed in independent lighting units that are easily carried to and positioned along the path. In this configuration of the preferred embodiment, no wires connect any of the lighting units.

The method 500 begins by lighting the first light, at 504, but not the second and third lights. The second light detects that the first light has been lit, at 506. For example, the second light can detect, as discussed above, a wireless signal that the first light transmits indicating that it has been turned on. A predetermined time after detecting the first light has been lit the second light is turned on, at 508. The first light is turned off, at 510, a predetermined time after the first light has been lit. This provides enough time for the athlete to see the light and judge their pace in comparison to their location to that light. In some configurations, the first light can be turned off when the second light is turned on.

The third light detects, at 512, that the second light has been lit. A predetermined time after detecting that the second light has been lit, the third light is turned on, at 514. The second light is turned off, at 516, a predetermined time after the second light has been lit. The third light is turned off, at 518, a predetermined time after the third light has been lit. These types of actions would continue for the fourth light, fifth light, sixth light and so on.

In the foregoing description, certain terms have been used for brevity, clearness, and understanding. No unnecessary limitations are to be implied therefrom beyond the requirement of the prior art because such terms are used for descriptive purposes and are intended to be broadly construed. Therefore, the invention is not limited to the specific details, the representative embodiments, and illustrative examples shown and described. Thus, this application is intended to embrace alterations, modifications, and variations that fall within the scope of the appended claims.

Moreover, the description and illustration of the invention is an example and the invention is not limited to the exact details shown or described. References to "the preferred embodiment", "an embodiment", "one example", "an example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in the preferred embodiment" does not necessarily refer to the same embodiment, though it may.

What is claimed is:

1. A method for setting a pace for an athlete comprising:

placing a plurality of lights, including a first light, a second light and a third light along a path to be traveled by the athlete, wherein the plurality of lights are housed in a plurality of independent lighting units with the first light in a first lighting unit, the second light in a second lighting unit and the third light in a third lighting unit, wherein no wires connect any of the plurality of lighting units;

determining a pace to be traveled by the athlete;

determining a series of time intervals at which the plurality of lights are to be sequentially lit;

lighting the first light but not the second and third lights when the athlete begins to move along the path;

detecting at the second light that the first light has been lit;

a predetermined time after the detecting the first light has been lit, turning on the second light;

turning off the first light a predetermined time after the first light has been lit;

detecting at the third light that the second light has been lit;

a predetermined time after the detecting the second light has been lit, turning on the third light;

turning off the second light a predetermined time after the second light has been lit; and turning off the third light a predetermined time after the third light has been lit.

2. The method for setting the pace for an athlete of claim 1 further comprising emitting a wireless signal from first lighting unit when the first light is lit; and wherein the detecting at the second light that the first light has been lit further comprises:

detecting that the first light has been lit by receiving and detecting the wireless signal at the second light.

3. The method for setting the pace for an athlete of claim 1 further comprising placing the plurality of lighting units so that the plurality of lighting units are equally spaced along the path to be traveled by the athlete.

4. The method for setting the pace for an athlete of claim 1 further comprising:

powering each of the plurality of lighting units with a power supply located in each lighting unit, wherein the first light is powered with a first power supply located in the first lighting unit, the second light is powered with a second power supply located in the second lighting unit and the third light is powered with a third power supply located in the third lighting unit.

5. The method for setting the pace for an athlete of claim 4 further comprising:

charging the first power supply located in the first lighting unit when the first lighting unit is not being used.

6. The method as defined in claim 1, wherein the athlete attempts to move past the second and third lights at the same time as the second and third lights are lit.

7. The method as defined in claim 1, further comprising matching the pace of the athlete to the timing of the lighting of the first, second, and third lights.

8. The method as defined in claim 1, further comprising:

comparing the position of the athlete on the path relative to the lighting sequence of the first, second, and third lights; and adjusting the pace of the athlete to match the lighting sequence of the first, second and third lights.

9. A system to pace an athlete about a path the athlete follows comprises:

a plurality of lights including at least a first light, a second light and a third light;

a first light housing to house the first light, a second light housing to house the second light and a third light housing to house the third light;

a first base housing for mounting to the first light housing to form a first light unit, wherein the first light is in the first light housing;

a second base housing for mounting to the second light housing to form a second light unit, wherein the second light is in the second light housing;

a third base housing for mounting to the third light housing to form a third light unit, wherein the third light is in the third light housing;

wherein the first light unit, second light unit and third light unit are portable;

and a portable controller configured to sequentially light the first light, then the second light and then the third light.

10. The system to pace an athlete about a path of claim 9 wherein the controller further comprises:

an antenna configured to transmit wireless messages.

11. The system to pace an athlete about a path of claim 9 wherein the first light is formed with one or more light emitting diodes (LEDs).

12. The system to pace an athlete about a path of claim 9 wherein the first light housing is formed with a cylindrically shaped tube with a spherical top end.

13. The method as defined in claim 9, wherein the portable controller is a handheld controller.

14. The method as defined in claim 9, wherein the controller is a cellular phone or an iPad®.

15. A method of pacing along a path traveled by the athlete comprising:

sequentially placing a first plurality of lights along a first portion of the path travelled by the athlete;

sequentially placing a second plurality of lights along a second portion of the path travelled by the athlete;

determining a pace to be traveled by the athlete;

determining a series of time intervals at which the first plurality of lights and the second plurality of lights are to be sequentially lit;

sequentially lighting the first plurality of lights one after each other one at a time with a first predetermined delay between the lighting of each of the first plurality of lights as athlete moves along the path;

after all the first plurality of lights have been lit, sequentially lighting the second plurality of lights one after each other one at a time with a second predetermined delay between the lighting of each of the second plurality of lights as the athlete moves along the path.

16. The method of pacing along a path traveled by the athlete of claim 15 wherein the first plurality of lights includes a first light and a second light and further comprising:

storing the first predetermined time delay in a storage location of the second light; and the sequentially lighting the first plurality of lights further comprises:

after the first light is lit, counting by a periodic time unit up to the first predetermined delay before lighting the second light.

17. The method of pacing along a path traveled by the athlete of claim 16 wherein the counting further comprises:

counting up with a digital counter up to the first predetermined delay, wherein the counter is clocked with a clock with a period of the periodic time unit.

18. The method of pacing along a path traveled by the athlete of claim 15 further comprising:

continuing to sequentially light the first plurality of lights and the second plurality of lights in a round-robin manner for a number of the laps the athlete is to complete.

19. The method of pacing along a path traveled by the athlete of claim 15 wherein the first predetermined delay is the same as the second predetermined delay.

20. The method of pacing along a path traveled by the athlete of claim 15 wherein only one of the first plurality of lights and second plurality of lights is lit at a time so that only one light is lit at a time.

21. The method of pacing along a path traveled by the athlete of claim 15 further comprising:

changing the second predetermined delay so that the second predetermined delay is different than the first predetermined delay.

22. The method of pacing along a path traveled by the athlete of claim 21 further comprising:

wirelessly broadcasting the second predetermined delay to the second plurality of lights.

23. The method of pacing along a path traveled by the athlete of claim 22 wherein the wirelessly broadcasting further comprises:

wherein the second predetermined delay is a wireless broadcast initiated at a portable computer and is sent to the second plurality of lights.

24. The method of pacing along a path traveled by the athlete of claim 23 wherein the wireless broadcast is broadcast from a universal serial bus (USB) connected to the portable computer.

25. The method as defined in claim 23, further comprising:

changing the second predetermined delay on the portable computer based on the pace of the athlete as the athlete moves past the first plurality of lights and then wirelessly broadcasting the changed second predetermined delay from the portable computer to the second plurality of lights.

* * * * *